United States Patent [19]

Bilsbury

[11] Patent Number: 4,625,650

[45] Date of Patent: Dec. 2, 1986

[54] MULTIPLE EFFECT AMMUNITION

[75] Inventor: Stephen J. Bilsbury, Godfrey, Ill.

[73] Assignee: Olin Corporation, Stamford, Conn.

[21] Appl. No.: 666,050

[22] Filed: Oct. 29, 1984

[51] Int. Cl.[4] ..... F42B 13/12; F42B 11/14

[52] U.S. Cl. ..... 102/516; 102/364; 102/517

[58] Field of Search ..... 102/514–515, 102/519, 364

[56] References Cited

U.S. PATENT DOCUMENTS

| | | | |
|---|---|---|---|
| 2,446,082 | 7/1948 | Dixon | 102/364 |
| 2,475,632 | 7/1949 | Moore et al. | 102/364 |
| 2,532,323 | 12/1950 | Miller, Jr. | 102/364 |
| 3,302,570 | 2/1967 | Marquardt | 102/519 |
| 3,946,673 | 3/1976 | Hayes | 102/364 |
| 4,353,302 | 10/1982 | Strandli et al. | 102/518 |
| 4,384,528 | 5/1983 | Moore et al. | 102/519 |

*Primary Examiner*—Harold J. Tudor

*Attorney, Agent, or Firm*—Bruce E. Burdick

[57] ABSTRACT

A copper jacketed explosive bullet for penetrating light armor, the bullet having a tubular hard heavy metal body filled with explosive and having an igniting mixture within the jacket forward of the explosive and a lightweight pyrophoric metal base plug for added burn time for increased fire starting ability.

5 Claims, 1 Drawing Figure

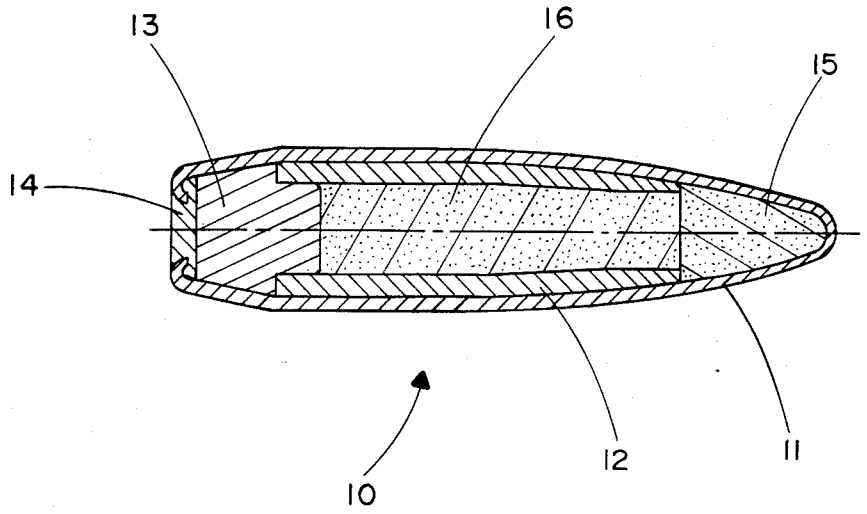
13
16
15
14
12
11
10

MULTIPLE EFFECT AMMUNITION

BACKGROUND AND SUMMARY OF INVENTION

This invention relates to a highly efficient, incendiary high explosive, light armor penetrating 12.7 mm (0.50") caliber projectile.

"Light armor" as used herein means armor having a resistance to penetration equivalent to less than 0.50" of rolled homogeneous armor plate at 100 meters.

"Parasitic mass" as used herein means mass which provides no propulsion to the projectile and which provides an inefficient deposition of energy on or within an impacted target. In order to design such a projectile, it is necessary to reduce its parasitic mass to a minimum. Lead, because of its softness and malleability, is an inefficient depositor of energy because it deforms so easily against the hard substance of such target materials as steel.

"Targets" as used herein mean inanimate armored objects such as vehicles or aircraft.

Past attempts at a multipurpose 0.50" caliber multipurpose ammunition round include the round disclosed in U.S. Pat. No. 4,353,302 issued Oct. 12, 1982 to Kaare R. Strandli and assigned to A/S Raufoss Ammunisjonsfabrikker of Raufoss, Norway. That round had a high density subcaliber penetrator in a hardened, high-explosive filled tubular steel body and a nose incendiary ignitable by impact with a target to in turn ignite the explosive after a suitable time delay. Upon testing, it has been found that further improvement in the round is desirable to achieve effectiveness on certain targets.

The projectile of the invention has a copper jacket surrounding a tubular hard, heavy metal inner core filled with explosive and has a nose filled with an ignitive mixture. By "hard, heavy metal" is meant tungsten, tungsten carbide, depleted uranium and the like. By "lightweight metal" is meant a metal that is lighter than "hard heavy metals". The rear end of the tube is an active (i.e. ignitable) metal such as aluminum, magnesium, or zirconium. In back of the active metal plug is a thin shield of lead. The use of each of the components will now be described. Existing weapon systems are designed for use with a copper jacket. Thus, it is necessary for the projectile to have a copper jacket in order to adequately interface with these weapon systems. The copper jacket engages the lands and grooves of the existing weapon system and spins-up and is thus stabilized in order to follow a true path to its intended target. The hard heavy metal tube has several functions. During the free flight condition, the hard heavy metal tube has a high polar moment of inertia and thus provides a high degree of stability to the projectile. This stability provides a very accurate projectile as a result. On impact with the target, the high density of the material in combination with its design of high sectional density provides a very effective means of penetrating the target. The ignitor mixture provides a measurable delay subsequent to which the explosive is detonated inside the target. Upon detonation of the explosive, the active metal which forms the base plug of the projectile becomes part of the explosive reaction and becomes ignited. One of the principle attributes of this active metal is that it burns for a relatively long time. Thus, if any fuel vapors are present, the burning active metal will help ignite them. The optional thin lead shield at the rear end of the projectile provides a seal which prevents the hot powder gases which propel the projectile from prematurely igniting the contents of the projectile.

DETAILED DESCRIPTION

The invention will be better understood by reference to the attached drawing which is a view of the projectile of the invention in longitudinal section.

The projectile 10 comprises a copper/tin jacket, a penetrator 12, a base plug 13, a nose incendiary 15 and a high explosive 16. Penetrator 12 is a tungsten alloy tubular body having shape of a hollow cylinder with tapered front and rear. Penetrator 12 is filled with a high explosive 16 designed to explosively fragment penetrator 12 upon ignition of the high explosives. The high explosive 16 is preferably sufficient to fill at least 80% of the internal volume defined by the internal wall of the tubular projectile body 12. Nose incendiary 15 is located immediately forward of high explosive 16 and can be either partly within penetrator 12 or wholely forward of penetrator 12. Nose incendiary 15 is designed to ignite when the projectile impacts the target at a sufficient velocity and to thereby ignite high explosive 16 after an amount of time sufficient to allow the penetrator to pass through an initial layer of target material to thereby cause the explosive fragmentation to occur at a location behind that initial target layer. For example, if the target were a fuel tank it would be highly desirable not only to create a leak but also to cause an explosion or start a fire within the fuel tank. Similarly, if the target were an airplane or helicopter it would be desirable for the projectile to penetrate the outer layers of the target and blow up inside the target, hopefully damaging vital personnel, electronics, wiring, engines, fuel lines or fuel tanks. Base plug 14 is preferrably made of aluminum, magnesium, zirconium or other reactive metal (metals which become pyrophoric when exposed to shock and blast effect) so that it is relatively low in weight and so that it will burn over a relatively long period when high explosive 16 is ignited. A prolonged burn is desirable to increase the likelihood of igniting fuel vapors which might be generated by the impact of the projectile upon a target or by the explosive fragmentation of the projectile within the target. Since base plug 13 is reactive, it is desirable to have a lead seal 14 at the rear of the projectile to keep the base plug and explosive from being ignited by the burning propellant gases during launch. Seal 14 is as thin as possible while still assuring that it will seal properly.

Although the projectile shown in the FIGURE is intended as a small caliber projectile. ("Small caliber" meaning of a caliber less than or equal to 0.50 inches.) The concept is not caliber dependent. In a 0.50 caliber configuration the expected weight of the projectile would be approximately 650 grain. For high velocity ammunition such as this, it is often desirable for aerodynamic reasons to have a "Boat-tail" (i.e. truncated tapered rear end) on the projectile and to this end the penetrator, or base plug could be rearwardly tapered. The exact amount of such taper would be a matter of conventional routine ballistic design work.

ADVANTAGES OF INVENTION IN COMPARISON TO PRIOR ART

During World War II a number of high explosive ammunition designs having tubular steel penetrators were developed at Frankford Arsenal. Those designs used a hardened steel tube by itself or backed up by a lead slug to increase the apparent sectional density of the projectile. The use of the steel tube by and of itself provided a projectile with a very low ballistic coefficient. Instead of the conventional hardened steel, the present invention uses a a tubular tungsten ("tungsten" as used herein means either tungsten alloy or tungsten carbide) penetrator. Tungsten has been a well known penetrator material for over forty years, yet has never before been used in a tubular penetrator design. Prior use of the steel tube in conjunction with a lead slug to back it up provided an inefficient use of the total volume of the projectile. In addition, those designs were either explosive or incendiary but not both. Also, one of those designs had a reactive metal base plug. Thus, although the shapes are similar, the materials, attributes and functions are entirely different. Furthermore, it will be seen that in no case is the presently claimed projectile currently in use nor were any of the prior tubular penetrator designs developed to the extent of being considered satisfactory so that it could remain in the inventory. Current ammunition designers look at those rounds only as outdated relics.

What is claimed is:

1. An explosive light armor penetrating projectile for launching through a rifled gun barrel, which round comprises;

a copper jacket for engaging the barrel rifling;

a tubular hard heavy metal projectile body having a front end and rear end, said body disposed immediately inside said jacket and having sufficient weight and hardness to penetrate light armor upon impact with a target at expected impact velocity;

a high explosive mixture disposed within said body for explosively fragmenting said body;

an igniting mixture located within the jacket forward of said high explosive mixture for igniting said explosive after a predetermined measurable delay so as to allow said projectile body to penetrate a target prior to detonation of said explosive;

a lightweight metal base plug located within the jacket behind the explosive and behind the body and consisting essentially of pyrophoric material which is adapted to burn over a relatively long period so as to increase the fire-starting ability of the rounds, and a non-flammable sealant layer behind said base plug for preventing ignition of base plug or high explosive mixture by the burning propellant during projectile launch.

2. The projectile of claim 1 wherein said round is of 0.50 caliber.

3. The projectile of claim 1, wherein the amount of said explosive in said round is sufficient to fill at least 80% of the internal volume defined by the internal wall of said tubular projectile body.

4. The projectile of claim 1 wherein the hard heavy metal projectile body is tungsten carbide.

5. The projectile of claim 1 wherein the hard heavy metal projectile body is depleted uranium.

* * * * *